United States Patent [19]

Holmstrom

[11] 4,448,053

[45] May 15, 1984

[54] METHOD OF STRESS ROLLING A METALLIC RIM

[75] Inventor: Roy C. Holmstrom, Lake Orion, Mich.

[73] Assignee: Rockwell International Corporation, Pittsburgh, Pa.

[21] Appl. No.: 379,398

[22] Filed: May 18, 1982

[51] Int. Cl.[3] ..... B21D 53/26; B21H 1/02

[52] U.S. Cl. ..... 72/102; 72/111; 29/159 R; 29/DIG. 42

[58] Field of Search ..... 72/67, 68, 80, 102, 72/105, 110, 111, 365, 366, 53, 205; 29/159 R, 159.1, DIG 36, DIG. 42, DIG. 49, 446

[56] References Cited

U.S. PATENT DOCUMENTS

| | | | |
|---|---|---|---|
| 2,234,850 | 3/1941 | Wallace | 29/DIG. 36 |
| 2,608,752 | 9/1952 | Schilling | 29/DIG. 36 |
| 3,131,457 | 5/1964 | Correll et al. | 72/53 |
| 3,438,229 | 4/1969 | Bartlett | 72/53 |
| 4,167,864 | 9/1979 | Taipale | 72/53 |

FOREIGN PATENT DOCUMENTS

| | | | |
|---|---|---|---|
| 688977 | 6/1964 | Canada | 29/173 |

*Primary Examiner*—Lowell A. Larson

[57] ABSTRACT

An improved method of stress rolling a metallic rim includes the additional step of applying an outside force to the rim to produce tensile stress in the region which is being stress rolled to produce a higher resulting compressive stress within the region than could otherwise be obtained through normal stress rolling.

2 Claims, 1 Drawing Figure

METHOD OF STRESS ROLLING A METALLIC RIM

BACKGROUND OF THE INVENTION

1. Field of the Invention

This invention relates to an improved method of stress rolling a metallic rim and, more specifically, one which will enhance the compressive stresses created in the rim during stress rolling.

2. Description of the Prior Art

It is well known that metallic rims of vehicle wheels or the like can be stress rolled to enhance the fatigue life of the rim which is being subjected to cyclical tensile stresses. Generally, this is accomplished by applying a compressive force to the rim in the portion thereof to be strengthened in a direction which is generally perpendicular to the direction of the tensile stresses produced therein. The application of the compressive force in this area will produce a compressive stress within the portion of the rim which is in the opposite direction to the eventual tensile stress. It has been found that "prestressing" in this manner enhances the fatigue life of such a rim which, during normal use, is expected to be repeatedly subjected to cyclical tensile forces. As a result, there remains a need for any method which might improve the efficiency and reliability of stress rolling.

SUMMARY OF THE INVENTION

It is, therefore, an object of this invention to provide an improved method of stress rolling a metallic rim to further enhance the fatigue life of the rim than could normally be expected by conventional stress rolling.

These and other objects of the invention are provided in a preferred embodiment thereof including an improved method of stress rolling a metallic rim of the type which includes the steps of mounting the rim for rotation, directing a stress roller into contact with a surface of a portion of the rim to be stress rolled and applying a predetermined force to the stress roller during the rotation of the rim to cause it to produce a predetermined compressive stress in the portion of the rim near the surface thereof as the stress roller entirely traverses the surface. The improvement includes the additional step of applying an outside force to the rim to produce a tensile force in the portion of the rim adjacent the surface thereof during the application of the predetermined force to the stress roller to produce a desired compressive stress in the portion of the rim near the surface thereof which exceeds the predetermined compressive stress.

DETAILED DESCRIPTION OF THE PREFERRED EMBODIMENT

Figure 1:
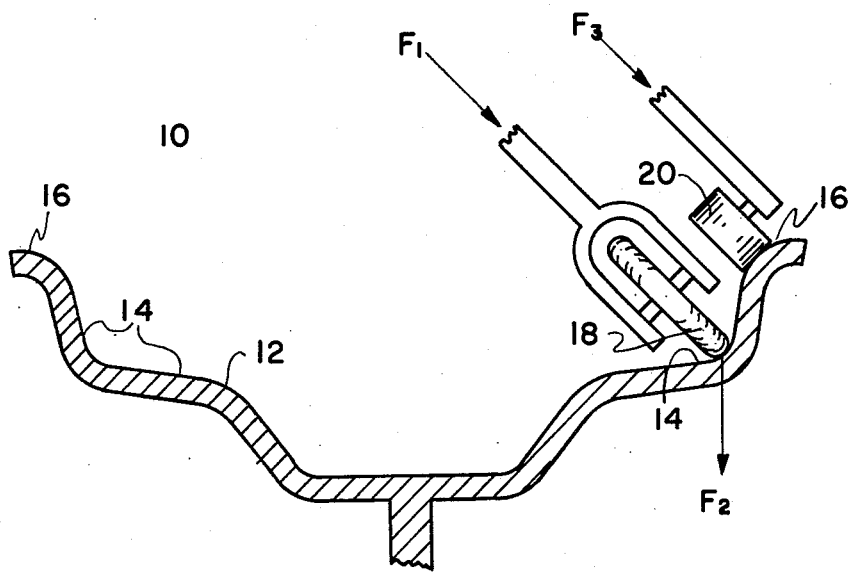
FIG. 1 shows a sectional profile of a vehicle wheel rim including various features of the invention.

As seen in FIG. 1, a vehicle wheel rim 10 is of the type which may be found on any number of automobiles or trucks. Although the present invention would be applicable for the stress rolling of other types of metallic rims, the vehicle wheel rim 10 can be utilized to demonstrate the various features of the invention.

In the manufacture and use of such vehicle rims, there is a concern that the normal loading and operation of the vehicle produces cyclical tensile stresses within the rim which can significantly effect the life of the rim and cause eventual fatigue failure in the generally axially extending section 12 of the rim 10. Specifically, a portion 14 of the section 12 adjacent each of the radially extending peripheral flanges 16 is subjected to tensile stresses at and near the tire side surface thereof because of the forces acting on the flanges 16. When a tire (not shown) is installed on the wheel and inflated with air, the tire sidewalls exert an outward force on the flanges 16 tending to axially expand the section 12 and, more significantly, establish a bending moment within the portion 14. A certain level of tensile stresses would exist in all circumferential regions of the portions 14 near the tire side surfaces thereof even if the wheel and tire were not mounted on a vehicle.

However, it has been found that when the wheel and tire are mounted on a vehicle, the regions of the portion 14 nearest the ground are subjected to higher stresses than the remaining circumferential regions of the portions 14. As the weight of the vehicle is transmitted to the ground through the tires, the sidewalls near the bottom of the tires exert a greater outward force on the flanges 16. Accordingly, as the wheel rotates, the tensile stresses at any one circumferential region of the portions 14 cycle from a basic level when the region is away from the ground to an increased level when the region is near the ground. These cyclical tensile stresses in the portion 14 near the tire side surface thereof during each revolution of the wheel results in fatigue stress which is a major case of wheel failure. Increasing the load on the vehicle would increase the magnitude of the cyclical tensile stresses and could further shorten the fatigue life of the wheel.

Accordingly, it has been found that it is advantageous for the portion 14 to be stress rolled to produce a residual compressive stress at and near the tires side surface thereof in opposition to the tensile stresses to enhance the fatigue life in this region. As seen in FIG. 1, this is accomplished by conventional means including a stress roller 18 which is caused to apply a compressive force at the surface of the portion 14 to create the compressive stress in the outer fibers of the metal, those fibers at the tire side surface of portion 14.

Specifically, a force F1 is applied mechanically, pneumatically or hydraulically to the stress roller 18 as it traverses the surface of the portion 14 during rotation of the rim 10. The outside surface of the stress roller 18 has a smaller radius than the radius of curvature of the portion 14 adjacent the flange 16 to insure that the stress rolling operation can be extended to the curved surface thereof. Although the preferred stress roller 18 is mounted at an angle which is not directly perpendicular to the axis of the rim 10, it should be understood that this particular angle is utilized to insure that the stress roller 18 can be brought into contact with the curved surface of the portion 14 adjacent the flange 16. There is nothing in the stress rolling process which requires such an angle. In fact, the significant predetermined force F2 to be applied to the portion 14 would really be the resulting component of the force F1 which would be perpendicular to the surface being rolled.

The improved method of stress rolling a metallic rim includes the conventional stress rolling operation as described hereinabout but adds an additional feature to enhance the quality of the compressive stress created in the portion 14. Specifically, a means is provided for applying an outside force F3 to the rim to produce a tensile stress at and near the tire side surface of the portion 14 of the rim 10 during the application of the predetermined force F2. In the preferred embodiment shown in FIG. 1, this is accomplished by directing a separate roller 20 into contact with the flange 16 to apply a bending moment to the rim 10 in that portion 14 thereof which is being stress rolled. As the force F3 is directed against the flange 16, there is a tendency for the outer fibers of the metal in the portion 14 to be under tension. The resulting tensile stress is in a general axial direction along the surface of the portion 14 of the rim 10. As the stress roller 18 applies a compressive force F2 at the tire side surface, a compressive stress is established in the outer fibers of the portion 14. When the force F3 being applied by the roller 20 is withdrawn from the flange 16 at the completion of the stress rolling operation, the flange 16 is urged back to its original position by the fibers beneath the outer fibers which have not been provided any residual compressive stress during the stress rolling. In any case, after this improved method of stress rolling, the outer fibers have been found to have a higher value of compressive stress than could have been obtained through the conventional stress rolling operation as described hereinabove without the use of the roller 20 or the temporary tensile stresses it produces.

As thus described, it should be clear that other means may be utilized to apply a force to such a rim 10 to create a tensile force in the region to be stress rolled without departing from the invention as claimed.

I claim:

1. An improved method of stress rolling a metallic rim of the type which includes the step of mounting said rim for rotation, directing a stress roller into contact with a surface of a portion of said rim to be stress rolled, and applying a predetermined force to said stress roller during said rotation of said rim to cause it to produce a predetermined compressive stress in said portion of said rim near said surface thereof as said stress roller entirely traverses said surface, said rim including a peripheral flange adjacent said portion, said improvement comprising: applying an outside force to said peripheral flange to produce elastic bending of said rim at said portion thereof in a direction which will create a tensile force in said portion of said rim adjacent said surface thereof during said step of applying said predetermined force to said stress roller to produce a desired compressive stress in said portion of said rim near said surface thereof which exceeds said predetermined compressive stress; and said step of applying said outside force being accomplished by directing a second roller means in axial alignment with said stress roller into contact with said peripheral flange.

2. The improved method of stress rolling as set forth in claim 1 wherein said outside force being applied by said second roller means is in a direction which is generally parallel to said predetermined force.

* * * * *